US010600598B2

(12) United States Patent
Sedeno Merchan et al.

(10) Patent No.: US 10,600,598 B2
(45) Date of Patent: Mar. 24, 2020

(54) RELAY

(71) Applicant: ELESTA GmbH, Ostfildern (DE) Zweigniederlassung Bad Ragaz, Bad Ragaz (CH)

(72) Inventors: Juan Cristobal Sedeno Merchan, Wadenswil (CH); Attila Gyorgy, Malans (CH); Antonino Spataro, Vilters-Wangs (CH)

(73) Assignee: ELESTA GMBH, OSTFILDERN (DE) ZWEIGNIEDERLASSUNG BAD RAGAZ (CH)

( * ) Notice: Subject to any disclaimer, the term of this patent is extended or adjusted under 35 U.S.C. 154(b) by 88 days.

(21) Appl. No.: 15/892,180

(22) Filed: Feb. 8, 2018

(65) Prior Publication Data

US 2018/0233313 A1 Aug. 16, 2018

(30) Foreign Application Priority Data

Feb. 8, 2017 (CH) ..... 143/17

(51) Int. Cl.
*H01H 3/00* (2006.01)
*H01H 50/24* (2006.01)
(Continued)

(52) U.S. Cl.
CPC ..... *H01H 50/24* (2013.01); *H01H 50/28* (2013.01); *H01H 50/34* (2013.01); *H01H 50/36* (2013.01); *H01H 50/44* (2013.01); *H01H 50/54* (2013.01)

(58) Field of Classification Search
CPC ..... H01H 50/24; H01H 50/34; H01H 50/44; H01H 50/54; H01H 50/36
(Continued)

(56) References Cited

U.S. PATENT DOCUMENTS 4,825,179 A * 4/1989 Nagamoto ..... H01H 50/26 335/128
4,827,232 A * 5/1989 Minks ..... H01H 50/02 335/128
(Continued)

FOREIGN PATENT DOCUMENTS

DE 3835105 8/1989
EP 1143474 10/2001
(Continued)

*Primary Examiner* — Shawki S Ismail
*Assistant Examiner* — Lisa N Homza
(74) *Attorney, Agent, or Firm* — Morriss O'Bryant Compagni Cannon, PLLC

(57) ABSTRACT

The invention relates to a relay, having an electromagnetic drive with a field coil arranged around an iron core which defines a plane, and a yoke. The electromagnetic drive works together with a movable armature which can switch a movable electrical contact via an actuating arrangement. The relay is accommodated in a housing, wherein an intermediate base and/or partition is included between the electromagnetic drive and the contact. The electromagnetic drive is arranged on one side of the partition, and the movable electrical contact is arranged on the other side of the partition. The partition has an opening through which the mechanical actuation of the contact is carried out. Because the armature is pivotable about an axis of rotation perpendicular to the plane of the iron core, the relay can have a lower constructed height than a conventional relay.

11 Claims, 5 Drawing Sheets

(51) Int. Cl.
*H01H 50/28* (2006.01)
*H01H 50/34* (2006.01)
*H01H 50/36* (2006.01)
*H01H 50/44* (2006.01)
*H01H 50/54* (2006.01)

(58) Field of Classification Search
USPC ..... 335/185
See application file for complete search history.

(56) References Cited

U.S. PATENT DOCUMENTS 4,831,348 A * 5/1989 Agatahama ..... H01H 51/2227 335/128
4,857,872 A * 8/1989 Bassino ..... H01H 50/28 335/80
4,914,411 A * 4/1990 Hikita ..... H01H 50/042 335/128
4,956,623 A * 9/1990 Rolf-Dieter ..... H01H 50/60 335/128
4,958,137 A * 9/1990 Schroeder ..... H01H 1/60 335/128
5,017,898 A * 5/1991 Kuzukawa ..... H01H 50/648 335/128
5,027,094 A * 6/1991 Yasuoka ..... H01H 50/042 335/202
5,038,122 A * 8/1991 Nakayama ..... H01H 50/042 335/202
5,049,845 A * 9/1991 Yokoyama ..... H01H 3/001 200/240
5,070,315 A * 12/1991 Kuzukawa ..... H01H 50/042 335/128
5,081,436 A * 1/1992 Nishi ..... H01H 50/021 335/131
5,204,647 A * 4/1993 Mitsuki ..... H01H 50/043 335/128
5,359,305 A * 10/1994 Kitamura ..... H01H 50/16 335/129
5,389,905 A * 2/1995 Shibata ..... F16F 9/535 335/78
5,396,204 A * 3/1995 Matsuoka ..... H01H 50/04 335/78
5,572,176 A * 11/1996 Heinzl ..... H01H 50/642 335/129
5,627,503 A * 5/1997 Mader ..... H01H 50/26 335/78
5,748,061 A * 5/1998 Tsutsui ..... H01H 50/60 335/83
5,801,608 A * 9/1998 Mader ..... H01H 50/54 335/128
5,844,456 A * 12/1998 Mader ..... H01H 50/026 335/78
5,894,254 A * 4/1999 Reiter ..... H01H 50/28 335/128
5,903,201 A * 5/1999 Reiss ..... H01H 50/14 335/128
6,034,582 A * 3/2000 Fausch ..... H01H 50/026 335/128
6,111,487 A * 8/2000 Hoffmann ..... H01H 11/0056 29/622
6,232,858 B1 * 5/2001 Reiter ..... H01H 50/18 335/128
6,265,958 B1 * 7/2001 Yoshino ..... H01H 50/023 335/274
6,337,614 B1 * 1/2002 Tsutsui ..... H01H 50/02 335/160
6,359,537 B1 * 3/2002 Ichikawa ..... H01H 49/00 335/78
6,448,877 B1 * 9/2002 Harayama ..... H01H 50/042 335/78
6,486,760 B2 * 11/2002 Miyazaki ..... H01H 50/36 335/129
6,489,868 B1 * 12/2002 Sato ..... H01H 50/38 335/128
6,606,018 B2 * 8/2003 Takano ..... H01H 50/026 335/78
6,621,394 B2 * 9/2003 Ono ..... H01H 50/042 335/159
6,633,214 B2 * 10/2003 Mochizuki ..... H01H 50/026 335/128
6,731,190 B2 * 5/2004 Yamashita ..... H01H 50/443 335/282
6,781,490 B2 * 8/2004 Funayama ..... H01H 50/026 335/78
6,784,773 B2 * 8/2004 Tsutsui ..... H01H 50/12 335/78
7,135,946 B2 * 11/2006 Hoffmann ..... H01H 50/048 335/78
7,335,040 B2 * 2/2008 Ota ..... H01H 50/14 335/78
7,439,834 B2 * 10/2008 Mochizuki ..... H01H 50/041 335/128
7,522,025 B2 * 4/2009 Zeitlberger ..... H01H 50/021 335/128
7,573,360 B2 * 8/2009 Bryan ..... H01H 1/605 335/201
8,026,782 B2 * 9/2011 Mikl ..... H01H 50/36 335/281
8,111,117 B2 * 2/2012 Minowa ..... H01H 50/28 335/129
8,179,217 B2 * 5/2012 Kawaguchi ..... H01F 7/1615 335/124
8,207,803 B2 * 6/2012 Iwamoto ..... H01H 50/026 335/128
8,253,519 B2 * 8/2012 Mikl ..... H01H 50/44 335/299
8,274,344 B2 * 9/2012 Kato ..... H01F 7/127 335/78
8,305,166 B2 * 11/2012 Kojima ..... H01H 50/043 335/78
8,305,167 B2 * 11/2012 Chida ..... H01H 50/043 335/119
8,493,164 B2 * 7/2013 Kurihara ..... H01H 50/047 335/78
8,922,307 B2 * 12/2014 Fujimoto ..... H01H 50/026 335/129
2004/0036561 A1 * 2/2004 Reiter ..... H01H 50/36 335/80
2006/0181376 A1 * 8/2006 Mikl ..... H01H 50/648 335/78
2007/0194866 A1 * 8/2007 Mikl ..... H01H 50/026 335/78
2007/0229203 A1 * 10/2007 Mikl ..... H01H 50/36 335/78
2008/0180197 A1 * 7/2008 Kubono ..... H01H 50/043 335/78
2015/0228431 A1 * 8/2015 Suzuki ..... H01H 50/54 335/133

FOREIGN PATENT DOCUMENTS

EP 1298691 2/2003
EP 1986209 10/2008
EP 2226827 8/2010
EP 2838101 2/2015

* cited by examiner

RELAY

CROSS-REFERENCE TO RELATED APPLICATION

This application claims priority to Swiss Patent Application No. 00143/17 filed Feb. 8, 2017, the entirety of which is incorporated by this reference.

FIELD OF THE INVENTION

The invention relates to relays.

PRIOR ART

German patent application DE-OS-38 35 105 shows an electromagnetic relay having a gate-shaped iron core, the central portion of which is inserted into a groove of a field coil body with a press fit, wherein a field coil is wound around the field coil body and the iron core contained inside it. The electromagnetic drive works together with a U-shaped armature which has a foot part at the lower side of one of the end portions, and has, opposite thereto, a stop element which limits the pivot angle of the armature. In addition, a recess is included on the upper side of the armature, opposite the foot part. This recess works together with a projection in the upper right corner of the iron core which is intended to prevent the armature from lifting. An actuating part made of insulating material, which works together with a leaf spring arrangement, is attached to the upper armature.

The leaf spring arrangement consists of a stationary leaf spring and a movable leaf spring, both arranged on an insulating support part in such a manner that the contacts of the two leaf springs are opposite each other and at a distance. Wall parts in which the walls oriented towards the center lie in the same plane project upwards on the end portions of the support parts lying opposite each other. One insertion passage is included in the base of the support part in front of each of the wall parts. One of the passages serves to receive the armature foot part, and the other works together with the stop element of the armature in order to limit the pivot angle thereof. A further wall element which prevents the armature from falling outward is included on the side of the armature foot part, at a distance from one wall element.

In the relay described, the armature is held in a stable position by the foot part, the recess which works together with the projection of the iron core, and the further wall element, such that the armature cannot tilt when operated.

A relay having a similar structure is disclosed in EP-A-2 226 827. This relay is characterized by a high position accuracy of the armature, and thus nearly immutable actuating characteristics. In this relay, each of the L-shaped armatures on opposite sides of the short limb has a projection—one of which is accommodated in a blind hole in the base, and the other of which is accommodated in a recess of the electromagnetic block. There is a stopper on the lower side of the armature opposite the projections, which engages with a recess in the base, said recess limiting the deflection of the armature. The armature has, in the central part, a casing of plastic, on one side of which a projection is molded onto the same. This projection protrudes through an opening in the partition and is in contact with a movable contact spring, which pretensions the armature in a terminal position which is limited by the recess which accommodates the stopper.

Relays with an analogous structure are also disclosed in patent applications EP-A-1 298 691 and EP-A-2 838101. All of the relays described above have in common that they have a gate-shaped iron core with a field coil arranged thereon, and an armature arranged in a plane which is substantially coplanar with the iron core.

A relay with a different construction is shown in EP-A-1 143 474 of the same applicant. The relay has an electromagnetic drive consisting of a coil which can be connected to a control current, a core/yoke and a movable armature. The electromagnetic drive is arranged on one side of a partition which is parallel to the core, wherein the armature can pivot about an axis of rotation parallel to the plane of the partition. A comb which can be moved by the armature, and a row of multiple contacts arranged on an electrically insulating support part, are arranged on the other side of the partition. The contacts consist of at least two contact elements, and can be actuated by the drive. At least one respective contact element is connected to a power connection element on the exterior of the relay. Likewise, at least one respective contact element—the same or a second—is formed by an elongated contact spring. The spring longitudinal axis of this contact spring is arranged transverse to the direction of movement of the comb, and parallel to the plane of the partition, and the contact spring is forcibly guided by the comb. A spring foot on one end of the contact spring is tightly fitted into the support part. The end opposite of the spring foot is movable and equipped with a contact head. For an optimal construction of the relay, the contact springs are arranged between the comb and the separating wall. This allows the length of the armature to extend over the entire height of the relay, thereby creating a relatively larger comb path with a low relay constructed height and small relay footprint.

The relay in EP-A-1 143 474 is a safety relay with forcibly guided contacts, according to standard EN 61810-3—that is, the clearances and creepage distances between the control contact and load contact comply with the requirements of the IEC 61810-5 and IEC 664-1 standards. In addition, spacings between conductive parts of the different load contacts must be observed according to voltage, degree of soiling, and field of application. The forcible guidance of the contacts also contributes to safety.

A forcibly guided relay is a relay in which the contacts are forcibly guided by means of a shared comb which is in contact with the drive, and in which there are at least one working contact and one normally closed contact. Forcibly guided means that in each case one contact element contacts a fixed stop, and a movable contact spring which works together with this contact element engages with the comb in such a manner that it necessarily moves with the movements of the comb. This ensures that, if a contact becomes fused, either the fused contact is torn apart or the comb cannot be moved, and therefore the other contacts—that is, the normally closed contact as well—must remain in the position resulting from the fusing.

EP-A-1 986 209 discloses a thin electromagnetic relay. The relay comprises an electromagnetic drive consisting of an iron core, a yoke connected to the iron core, and a coil, as well as an armature which is held by means of a spring on the armature, and pretensioned in the open position. The armature has an approximately L-shaped design, and has a first limb which is substantially rectangular and is able to cover the end face of the drive. The second limb of the armature is narrower than the first limb, and protrudes from its flat side at an angle of slightly more than 90 degrees. The second limb works with an elastically deformable actuating part made of plastic. The actuating part in turn acts on a central spring contact, which contacts a first, fixed contact element in the de-energized state of the electromagnetic drive, and contacts a second, fixed contact element in the excited state. In order to be able to act on the central contact, the first fixed contact element has a passage for a projection of the actuating part. In the case of the relay of EP-A-1 986 209, the movable actuating element thus also simultaneously ensures electrical isolation of the contacts from the electromagnetic drive. The narrow limb of the armature acting as an actuating arm rotates about an axis of rotation which runs perpendicular to the flat side of the iron core.

Although the relays described above are already very compact in construction, there exists a need to miniaturize the same even further.

Advantages of the Invention

The present invention furthers the development of the relay described last, such that it takes up less space. The invention proposes a miniaturized relay with a compact design, which ensures reliable, long-term operation. The present invention provides a relay which also works reliably when subjected to shaking. In addition, the relay is also be easy to assemble and optimally adjustable.

SUMMARY OF THE INVENTION

The invention relates to a relay, having an electromagnetic drive with a coil and a yoke, and having a movable armature which works together with the electromagnetic drive. The armature is mechanically connected via an actuating arrangement to a movable, electrical contact. A stationary, immobile partition is arranged between the electromagnetic drive and the contact. The electromagnetic drive is arranged on one side of the partition, and the movable electrical contact is arranged on the other side of the partition. The partition has an opening through which the mechanical actuation of the contact is carried out.

According to the invention, in the above-mentioned relay, the armature can pivot about an axis of rotation perpendicular to the plane of the iron core, and the actuating arrangement has an actuating arm which engages through the opening. This arrangement makes it possible to give the electromagnetic drive a lower constructed height than an arrangement in which the axis of rotation of the armature runs horizontal to the plane of the iron core. The coil body and coil are therefore rectangular in cross-section, wherein the width of the coil is at least 1.5 times, or at least 2 times, greater than the height.

Means are advantageously provided to push the armature against the yoke. These pressing means serve the function of holding a terminal portion of the armature on the end face of the yoke.

According to one embodiment, the armature is retained by an armature retainer attached to the yoke. This embodiment has the advantage that it is inexpensive and independent of the positioning of the electromagnetic drive relative to the partition or to the housing.

Advantageously, the armature retainer has a spring which pretensions the armature against the end face of the yoke. The spring in this case presses, against the end face of the yoke, the end portion of the armature about which the armature is pivoted. This is a simple and efficient construction.

The spring is expediently formed on the stop element. This has the advantage that only one component is necessary for fixing the armature.

The spring may have a bent end portion which can engage with an indentation on the armature. This has the advantage that the armature is precisely positioned and retained on the armature retainer by the spring.

Advantageously, the armature has an actuating arm which protrudes on the lower side and/or from a narrow side of the armature, and has a mechanical connection to the actuating part. The actuating arm can pass through the plane spanned by the partition, and actuate the actuating part situated on the other side of the partition, wherein the actuating arm could also be part of the actuating part.

The armature is advantageously a substantially rectangular iron plate on which the actuating arm is molded or formed on an end portion which is opposite the end portion around which the armature rotates. In plan view, the armature therefore advantageously has, together with the actuating arm, a substantially L-shaped form, and not, in contrast to the prior art cited above, a T-shape. Because of the asymmetrical shape of the armature, the forces arising upon actuation of the relay accordingly act asymmetrically on the armature, and there is a fundamental risk of the armature lifting off the pole face on the side of the actuating arm. However, this can be counteracted by a corresponding embodiment of the armature retainer.

According to another, independent aspect, the subject matter of the present invention is a relay which has a positioning pin on the yoke, said positioning pin held positively in an opening in the partition. The positioning pin in this case serves as a base point for the balancing between the pole face of the drive and the contact arrangement on the other side of the partition wall. This has great advantages for the exact positioning of the drive, with the yoke and armature, and the contacts on the other side of the partition.

Advantageously, the positioning pin is an extension of the pole plate—that is, an extension of the front end face of the yoke.

In one embodiment, one or more elevations are included on the interior wall of the opening. These serve the purpose of pressing and precisely positioning the positioning pin against a certain wall of the opening.

BRIEF DESCRIPTION OF THE DRAWINGS

An embodiment of the invention is described in more detail below with reference to the drawings, wherein.

DETAILED DESCRIPTION OF THE INVENTION

Figure 1:
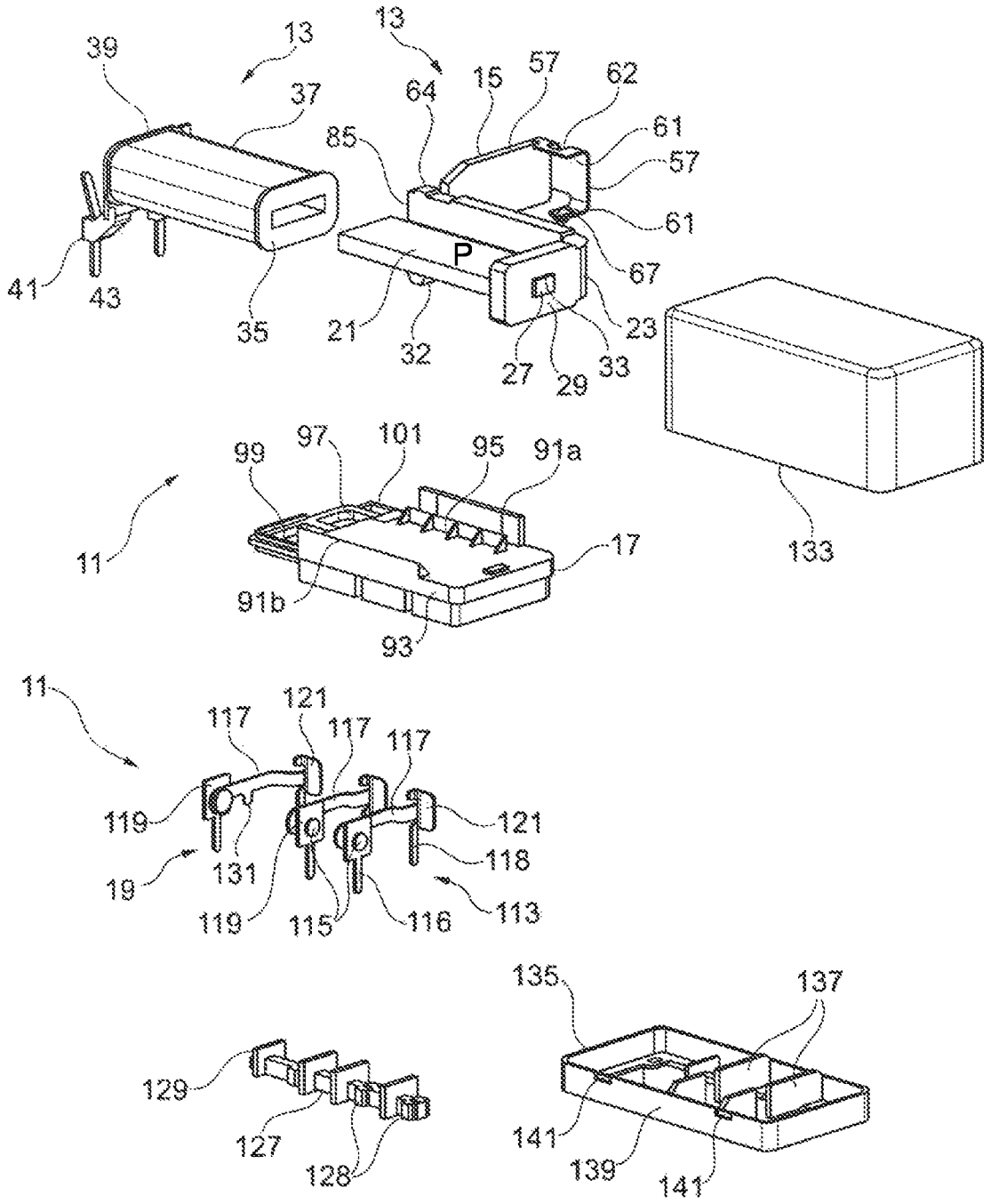
FIG. 1: shows an embodiment of a relay according to the invention, having an electromagnetic drive, an armature, a partition, a contact arrangement, and a housing with a base, seen in an exploded view and in a view from the side of the magnetic circuit.

The essential components of the relay 11 shown in FIGS. 1 to 8 are an electromagnetic drive 13, an armature 15 which can be actuated by the electromagnetic drive 13, an intermediate base or partition 17, and a contact arrangement 19, which are described in more detail below in this order.

The electromagnetic drive 13 comprises a flat iron core 21 and a yoke 23 arranged on the same. Both the iron core 21 and the yoke 23 are made of one flat piece of ferromagnetic iron. The iron core 21 is rectangular when viewed from above, and a projection 27 is included (FIG. 8) in the center of a narrow side 25. The yoke 23 has an L-shape with a short limb 29 and a long limb 31, wherein the center planes of the two limbs 29, 31 are perpendicular to the center plane P of the iron core 21. A positioning pin 32, projecting at a right angle, is included on the free end of the long limb 31, the function of which is described in more detail further below.

For the connection of the iron core 21 and the yoke 23, the projection 27 of the iron core 21 is received positively in a passage 33 of the limb 29, and may be realized as a press fit. An intermediate space 34 is included between the limb 31 and one side of the iron core, serving the purpose of receiving a coil body 35 and the field coil 37 wound around the same, in the shape of a flattened cuboid. Two receptacles 41, each for one connecting pin 43 of the field coil 37, are included on, and/or molded onto, the end wall 39 of the coil body 35, spaced apart from each other.

Figure 8:
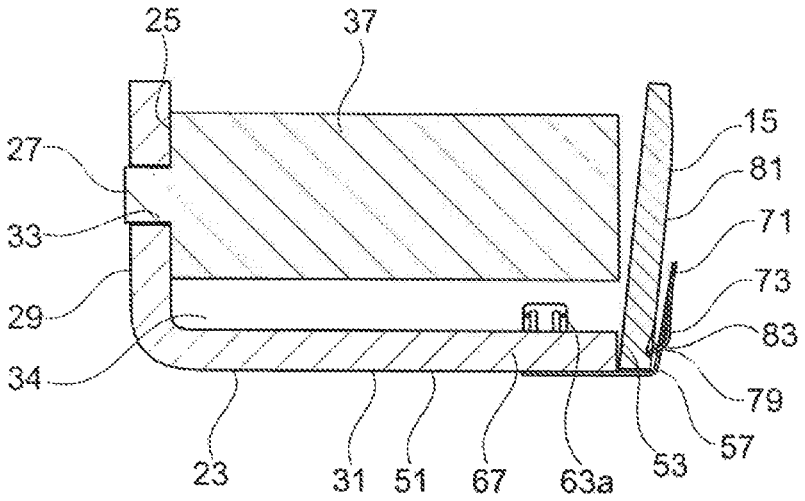
FIG. 8: shows the electromagnetic drive in a sectional view.
Figure 9:
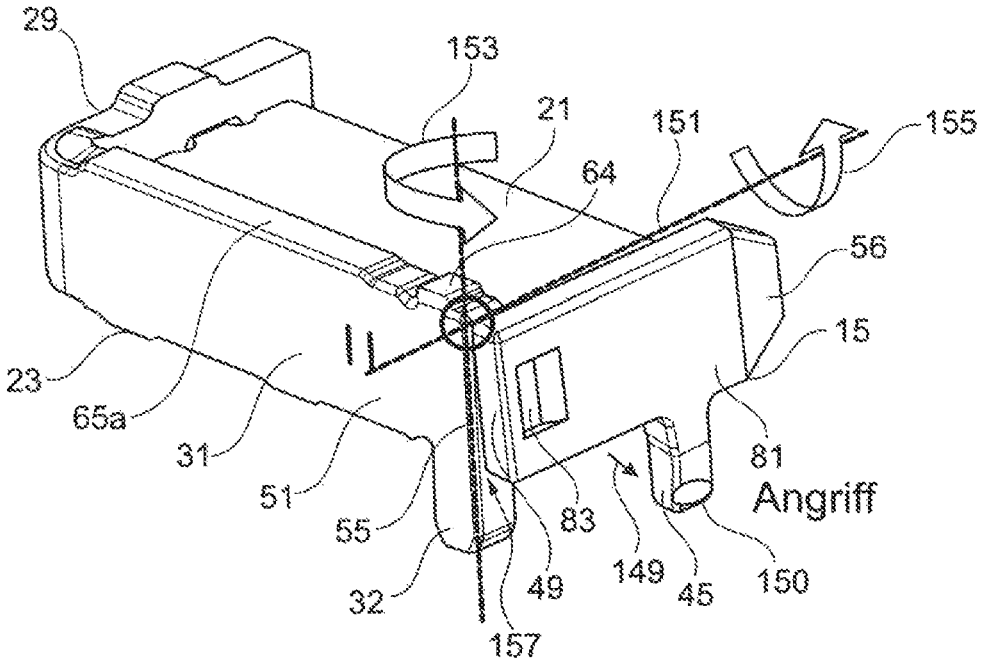
FIG. 9: schematically shows the axes of rotation of the armature.

The armature 15 is arranged on the front side of the electromagnetic drive 13. It is also made of a ferromagnetic material. The armature 15 is rectangular and has approximately the same dimensions as the short limb 29 of the yoke 23. An elongated actuating arm 45 which can work together with an actuating part 47 made of an insulating material (see FIGS. 1, 2 and 4) is included on the lower side of the armature 15. The front side 49 of the armature 15 is substantially flush with the external flat side 51 of the yoke 23 when the relay is activated, wherein the lateral edge which contacts the end face 53 of the limb 31 defines an axis of rotation 55 about which the armature 15 is ideally pivoted during actuating (FIGS. 8 and 9). As is apparent from the figures, the armature 15 has a truncated pyramidal end portion 56 so that the armature 15 does not contact the one connector pin 41 when in the open position.

Figure 3:
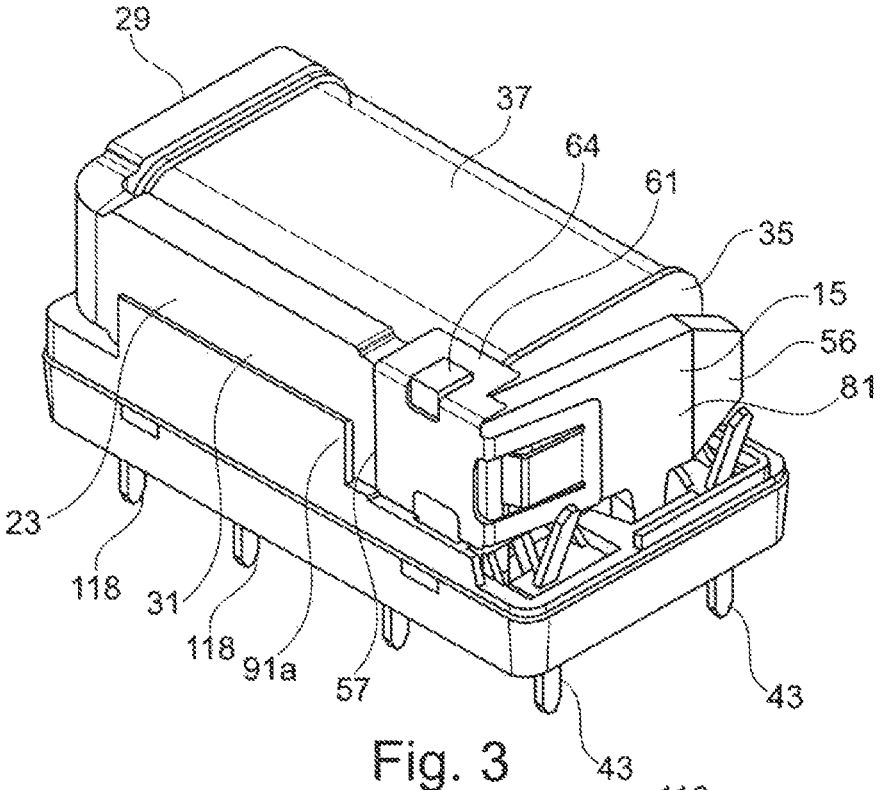
FIG. 3: shows a perspective view of the relay, but without the housing.
Figure 4:
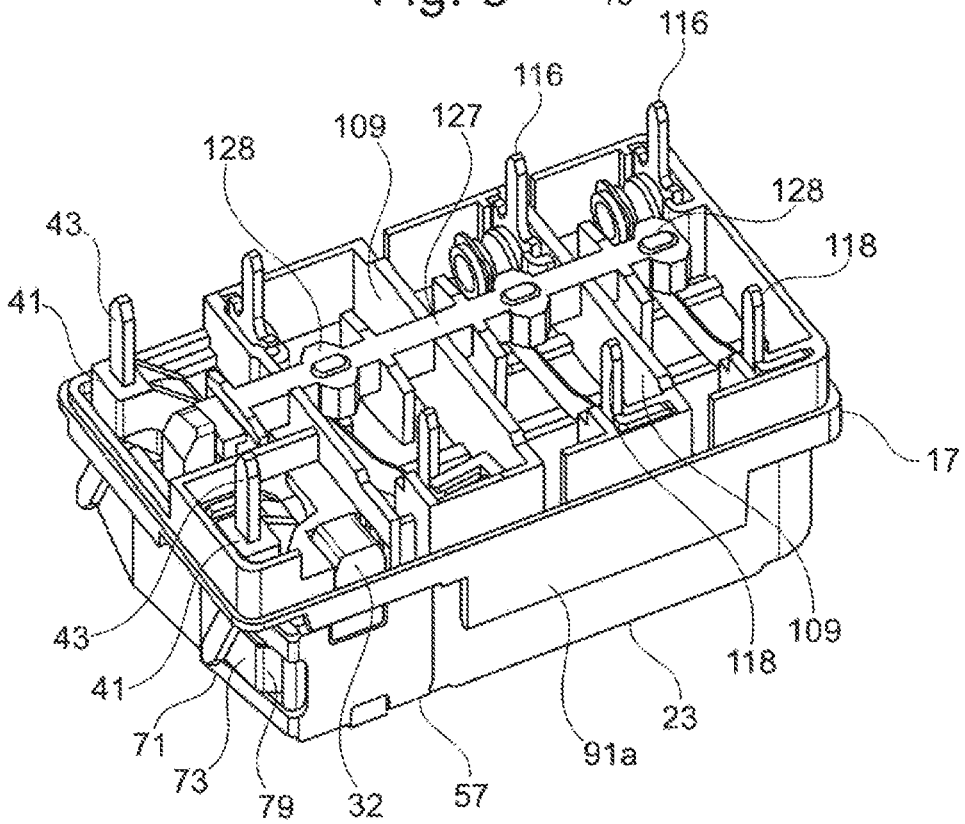
FIG. 4: shows a perspective view of the lower side of the relay, without housing and without base.
Figure 5:
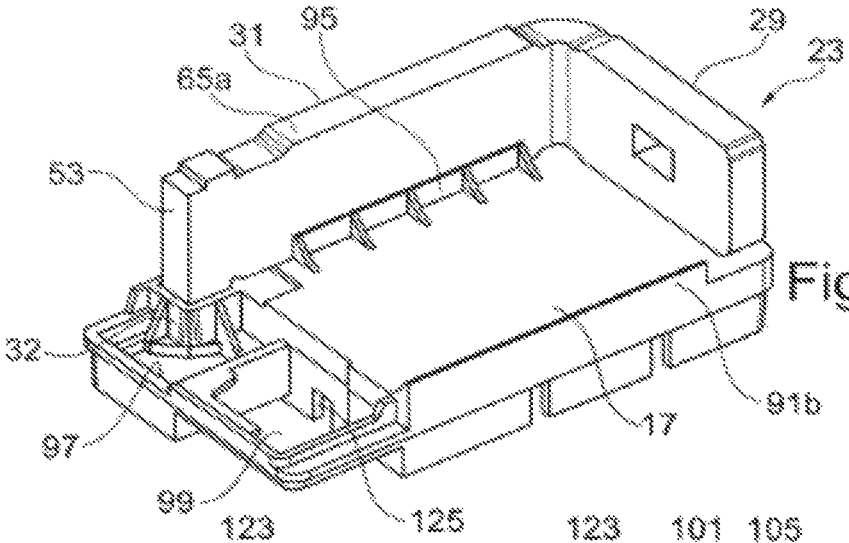
FIG. 5: shows the partition with yoke in a perspective view.

The armature 15 is held in an armature retainer 57 which can be snapped onto the limb 31 of the yoke 23. The armature retainer 57 is made of a spring-elastic thin copper sheet. The armature retainer 57 comprises a rectangular base 59 which, in the finished relay, lies against the flat side 51 of the limb 31. A locking part 61 and support arms 63*a*, 63*b* opposite the same protrude from the base part 59 at a right angle. The locking part 61 has a recess 62 which is able to work together with a locking projection 64 on the upper narrow side 65*a* of the limb 31 for the purpose of producing a positive connection (FIG. 3). The holding arm 61*a* engages with the opposite narrow side 65*b* of the limb 31, and additionally has an inwardly protruding locking tab 67 which latches into the interior side of the limb 31 when the armature retainer 57 is pushed onto the yoke 23 (FIG. 8). This way, the position of the armature retainer 57 on the yoke 23 is precisely fixed. The armature 15 is clamped between the retaining arm 61*b* and the locking part 61.

The armature retainer 45 further comprises a further rectangular stop element 71 which protrudes at an angle of slightly more than 90 degrees. This is included for the purpose of limiting the deflection of the armature about the axis of rotation 55. If the starting position is considered to be that in which the armature lies against the iron core, the stop element 71 limits the deflection of the armature to a maximum of 12 degrees, or to a maximum of 8 degrees. An armature retaining spring 73 is included on the stop element 71, and is integrally connected with the stop element 71 according to the advantageous embodiment shown. It is produced by cutting or punching out a rectangular piece from the stop element 71 along three edges, and bending the same in such a manner that it projects at an angle from the plane of the stop element 71. An edge portion 79 of the armature retaining spring 73 is also additionally bent. With this edge portion 79, the armature retaining spring 73 can engage with an indentation 83 on the outer side 81 of the armature, and press the armature 15 against the end face 85 of the yoke (FIGS. 8 and 9).

The partition 17 serving as an intermediate base separates the electromagnetic drive 13 from the contact arrangement 19, and also serves as a support base for the electromagnetic drive 13. The partition 17 has upwardly projecting ribs 91*a*, 91*b* on the first side thereof, each of which is flush with the exterior 93 of the partition 17 (FIG. 1). A further upwardly projecting rib 95 is included at a distance from the rib 91*a*, forming a space together with the rib 91*a* to receive the yoke limb 31. In the front end portion, the partition 17 has two larger passages 97, 99 through which the receptacles 41 can protrude with the connector pins 43 and the actuating arm 45 of the armature 15.

Figure 6:
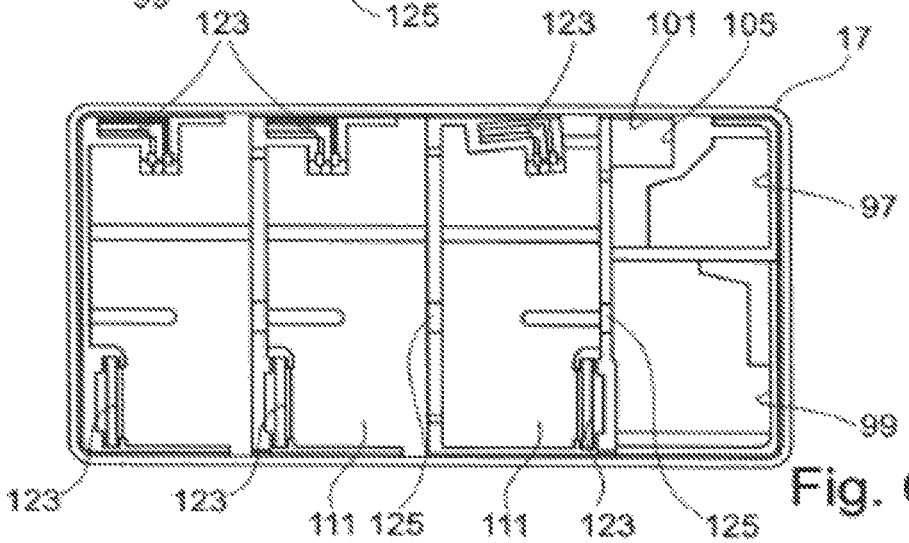
FIG. 6: shows a view of the lower side of the partition, but without the contact arrangement.
Figure 7:
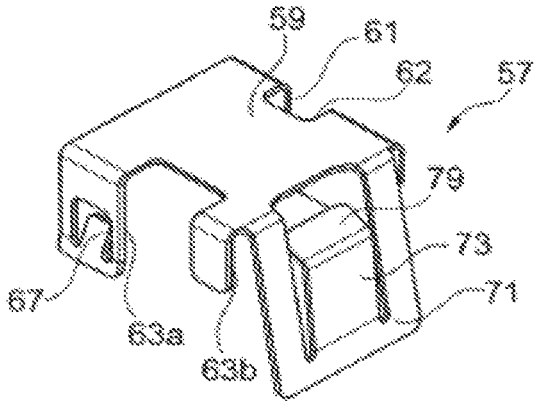
FIG. 7: shows an armature retainer in a perspective view.
Figure 10:
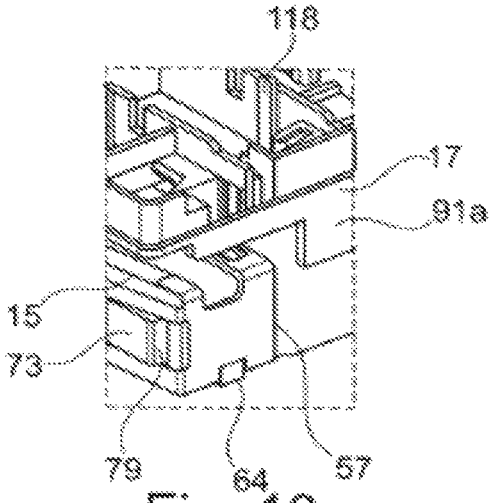
FIG. 10: shows a partial view of the relay of FIG. 4, but without the positioning pin.

A further hole 101 in the partition 17 serves to receive the positioning pin 32 (FIGS. 1 and 6). The latter is pressed against the front interior wall 105 (FIGS. 6 and 10) by small elevations on the inside of the hole 101. In addition, the two remaining interior walls can be slightly conical.

Figure 2:
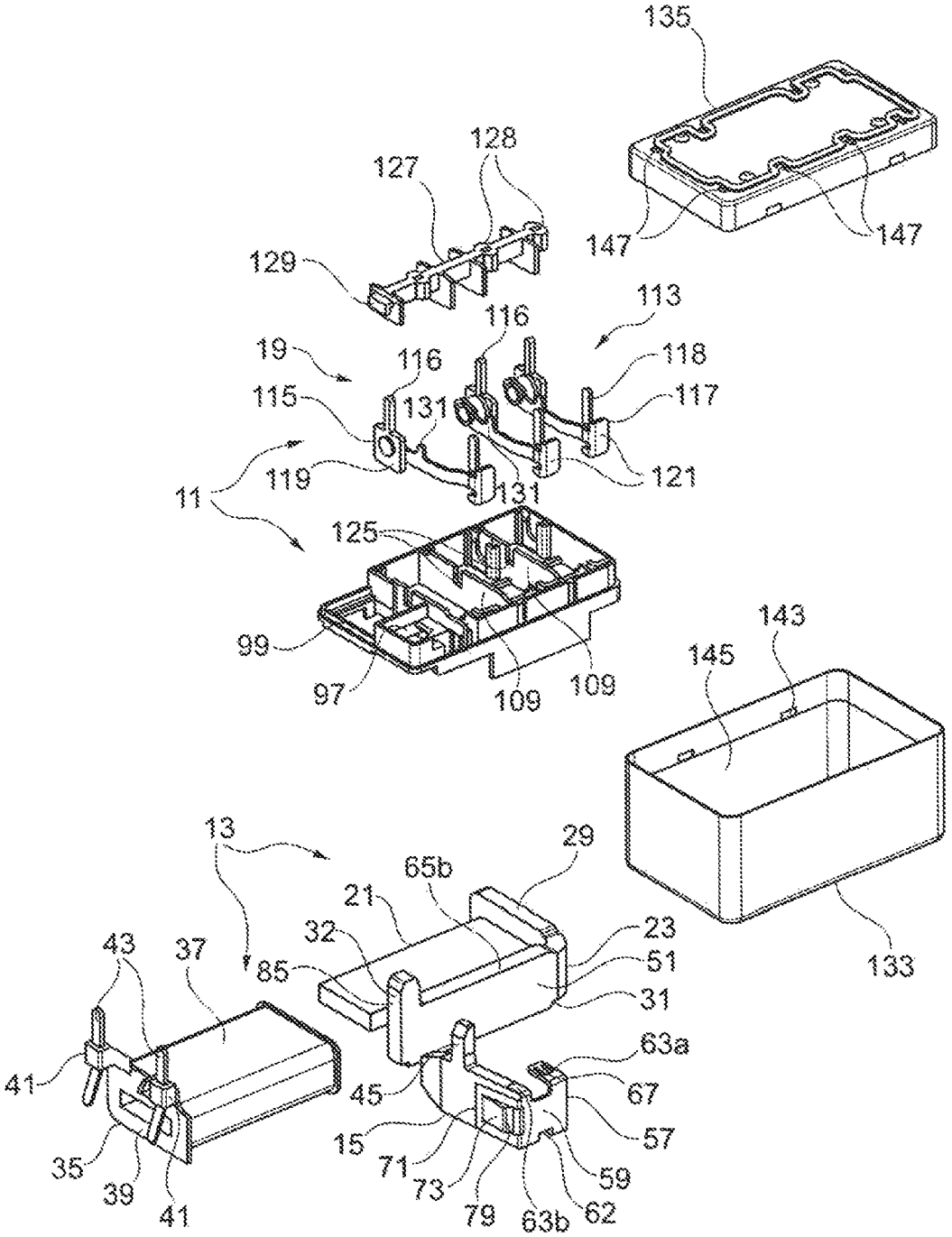
FIG. 2: shows the relay of FIG. 1, also in an exploded view, but viewed from the side of the contacts chamber.

A plurality of compartments 111 divided by partitions 109 are present on the second side of the partition wall 17, each of which enables the arrangement of a contact pair 113 (FIGS. 1 and 2). Each contact pair 113 consists of a fixed contact element 115 with a contact pin 116 and a movable contact element 117 with a contact pin 118. The contact elements 115, 117 are received with their foot parts 119, 121 in pockets 123 (FIG. 2 and FIG. 6).

The partitions 109 have openings 125 in which a comb 127 (FIG. 6) which functions as an actuating part 47 is received. The comb 127, which can move in the direction of its longitudinal axis, has actuators 128 (FIG. 2) arranged at certain intervals from each other, which receive the upwardly projecting cams 131 of the movable contact elements 117. The front end 129 of the comb 127 lies against the actuating arm 45, and pretensions the same in a first end position, in which the armature 15 is remote from the yoke 23, by the spring force of the movable contact elements 117. This is the case when the field coil 37 is not active. If the field coil 37 is energized, the armature 15 is pulled to the yoke 23 and the contacts are switched.

The electromagnetic drive 13 and the partition 17 equipped with the contact arrangement 19 are accommodated, when in the finished state, in a housing 133 which can be closed by a base part 135. The base part 135 has a plurality of division bars 137 which are arranged between the individual contact pairs 113 in order to improve the creep resistance of the relay. The long, lateral walls 139 have locking projections 141 which can engage in corresponding locking grooves 143 on the interior wall 145 of the housing 133. The base part 135 has a plurality of passages 147 for the contact pins 116, 118 and connector pins 43.

In FIG. 9, the arrow 149 indicates the point 150 on the actuating arm 45 which is contacted by the front end 129 of the comb 127, which is pretensioned by the contact springs of the movable contacts 117. Upon contact on the actuating arm 45, the armature 15 would rotate about both the vertical axis of rotation 55 (arrow 153) and about an axis of rotation 151 (arrow 155). As a result, a gap 157 would open between the end face 53 of the yoke 23 and the armature 15, and lead to a weakening of the magnetic field. However, this disadvantageous effect can be prevented by means of the armature retaining spring 73, which presses the armature 15 against the end face 53 of the yoke limb 31.

The embodiment of a relay 11 shown in the figures has three contact pairs 113, and is designed as a so-called safety relay with forcibly guided contacts. However, the invention is not limited to safety relays with forcibly guided contacts. Rather, it can be used for ordinary relays without forcibly guided contacts as well.

The invention claimed is:

1. A relay, comprising:

an electromagnetic drive having a field coil arranged around an iron core that defines a plane, and a yoke;

a movable armature operably connected to the electromagnetic drive, the movable armature held by an armature retainer that is attached to the yoke, the armature retainer having a spring that pretensions the moveable armature against an end face of the yoke;

a movable electrical contact operably connected to the armature; and a housing having a stationary partition arranged between the electromagnetic drive and the contact, wherein the electromagnetic drive is arranged on one side of the partition, and the movable electrical contact is arranged on the other side of the partition, and the partition wall has an opening through which mechanical actuation of the contact occurs;

the movable armature pivotable about an axis of rotation perpendicular to the plane of the iron core, and having an actuating arm that passes through the opening in the partition and cooperates with an actuating member to actuate the movable electrical contact.

2. The relay according to claim 1, wherein the armature is pressed against the yoke.

3. The relay according to claim 1, wherein the armature retainer comprises a stop element that protrudes at an angle and that limits a deflection of the armature.

4. The relay according to claim 3, wherein the spring is formed on the stop element.

5. The relay according to claim 4, wherein the spring has a bent end portion that can engage with an indentation on the armature.

6. The relay according to claim 1, wherein the actuating arm of the movable armature protrudes substantially perpendicularly from a narrow side of the movable armature and is mechanically connected to the actuating member.

7. The relay according to claim 1, wherein the actuating arm is formed on a side of the movable armature that is opposite the axis of rotation.

8. The relay according to claim 1, wherein the relay comprises a safety relay with forcibly guided contacts.

9. A relay, comprising:

an electromagnetic drive having a field coil arranged around an iron core that defines a plane, and a yoke;

a movable armature operably connected to the electromagnetic drive, the movable armature held by an armature retainer that is attached to the yoke, the armature retainer having a spring that pretensions the moveable armature against an end face of the yoke;

a movable electrical contact operably connected to the movable armature; and a housing with a partition arranged between the electromagnetic drive and the movable electrical contact;

the yoke having a positioning pin that is positively held in an opening in the partition.

10. The relay according to claim 9, wherein the positioning pin comprises an extension of a pole plate of the armature.

11. The relay according to claim 9, further comprising one or more elevations on an interior wall of the opening.

* * * * *